US011830686B2

(12) United States Patent
Fehling et al.

(10) Patent No.: US 11,830,686 B2
(45) Date of Patent: Nov. 28, 2023

(54) ELECTRIC PUSH-BUTTON SWITCH

(71) Applicant: KOSTAL Automobil Elektrik GmbH & Co. KG, Luedenscheid (DE)

(72) Inventors: Andre Fehling, Sundern (DE); Kristian Lanzon, Dortmund (DE)

(73) Assignee: KOSTAL Automobil Elektrik GmbH & Co. KG, Luedenscheid (DE)

( * ) Notice: Subject to any disclaimer, the term of this patent is extended or adjusted under 35 U.S.C. 154(b) by 4 days.

(21) Appl. No.: 17/667,626

(22) Filed: Feb. 9, 2022

(65) Prior Publication Data

US 2022/0165518 A1 May 26, 2022

Related U.S. Application Data

(63) Continuation of application No. PCT/EP2020/072670, filed on Aug. 12, 2020.

(30) Foreign Application Priority Data

Aug. 17, 2019 (DE) ..... 10 2019 005 800.3

(51) Int. Cl.
*H01H 13/30* (2006.01)
*H01H 13/14* (2006.01)
*H01H 13/52* (2006.01)

(52) U.S. Cl.
CPC ..... *H01H 13/30* (2013.01); *H01H 13/14* (2013.01); *H01H 13/52* (2013.01);
(Continued)

(58) Field of Classification Search
CPC ..... H01H 13/30; H01H 13/14; H01H 13/52; H01H 2215/034; H01H 2221/044;
(Continued)

(56) References Cited

U.S. PATENT DOCUMENTS 3,773,998 A * 11/1973 Seeger, Jr. ..... H01H 13/14 200/330
4,864,085 A * 9/1989 Hanajima ..... H01H 13/705 200/513

(Continued)

FOREIGN PATENT DOCUMENTS

DE 1212562 A1 10/1993
DE 69122619 T2 2/1997

(Continued)

OTHER PUBLICATIONS

The International Bureau of WIPO, International Preliminary Report on Patentability for International Application No. PCT/EP2020/072670 dated Feb. 17, 2022.

(Continued)

*Primary Examiner* — Lheiren Mae A Caroc
(74) *Attorney, Agent, or Firm* — Brooks Kushman P.C.

(57) ABSTRACT

An electric pushbutton switch includes a guide housing, a switching element having a haptic element that produces a pressure point and a return spring that generates a restoring force, an actuator for actuating the switching element, and a resilient tolerance compensation element arranged between the guide housing and the actuator. The switching element being stationary relative to the guide housing and the actuator being movable relative to the guide housing. The actuator actuates the switching element against the restoring force when the actuator is moved relative to the guide housing in an actuating direction of the actuator towards the switching element. The resilient tolerance compensation element is arranged between the guide housing and the actuator. The resilient compensation element has a spring force directed in the actuating direction of the actuator towards the switching element and opposite the restoring force of the return spring of the switching element.

12 Claims, 7 Drawing Sheets

(52) U.S. Cl.
CPC . *H01H 2215/034* (2013.01); *H01H 2221/044* (2013.01); *H01H 2235/004* (2013.01)

(58) Field of Classification Search
CPC ..... H01H 2235/004; H01H 2221/058; H01H 13/06; H01H 3/12; H01H 5/04; H01H 5/06; H01H 5/08; H01H 5/30; H01H 13/20; H01H 13/22; H01H 13/26; H01H 13/28; H01H 13/285; H01H 13/48; H01H 13/50; H01H 13/84; H01H 2215/004; H01H 2221/036; H01H 2227/022; H01H 2227/032; H01H 2235/002; H01H 2235/01; H01H 2235/02; H01H 2235/016
See application file for complete search history.

(56) References Cited

U.S. PATENT DOCUMENTS 5,231,386 A 7/1993 Brandenburg et al.
5,380,970 A * 1/1995 Mizuno ..... H01H 13/562 200/523
5,499,041 A 3/1996 Brandenburg et al.
2011/0214974 A1 9/2011 Bigand
2014/0172186 A1* 6/2014 Mashkevich ..... G05G 1/00 701/1

FOREIGN PATENT DOCUMENTS

DE 102004034554 A1 2/2006
DE 102014003087 A1 9/2015
DE 102014219316 A1 3/2016
DE 102014221960 A1 4/2016
EP 3020896 A1 5/2016
JP S4967969 U 6/1974
JP S56175936 U 12/1981
JP 2003303527 A 10/2003

OTHER PUBLICATIONS

European Patent Office, International Search Report for International Application No. PCT/EP2020/072670, dated Nov. 25, 2020.
German Patent and Trademark Office, German Search Report for corresponding German Patent Application No. 10 2019 005 800.3, dated Mar. 27, 2020.

* cited by examiner

Fig. 4 (Conventional)
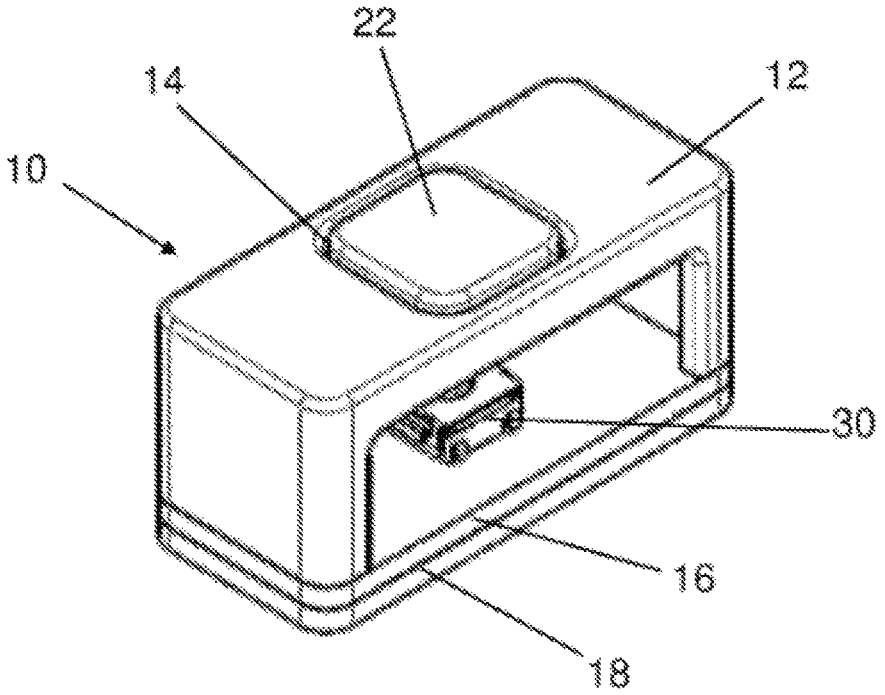
Fig. 5 (Conventional)
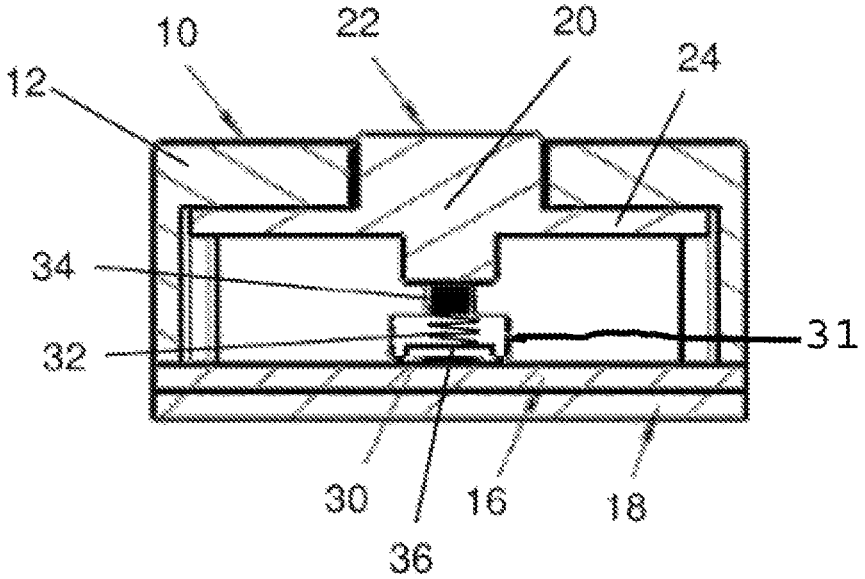

Fig. 6 (Conventional)
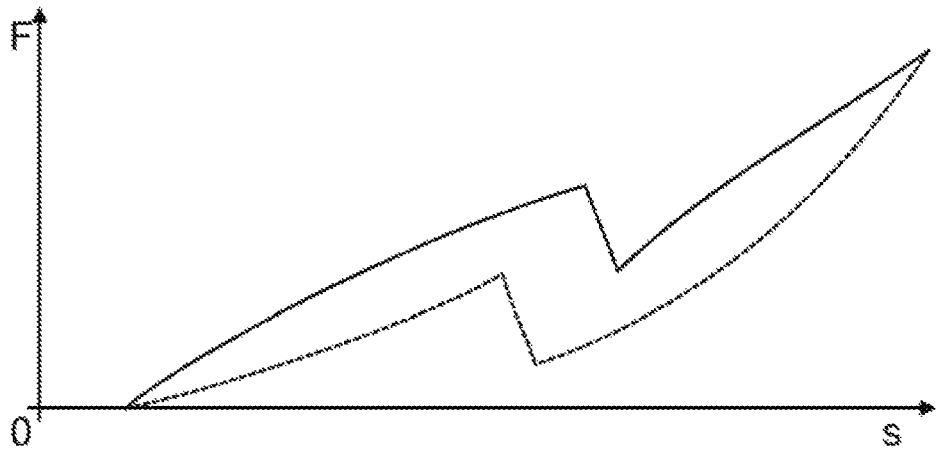
Fig. 7 (Conventional)
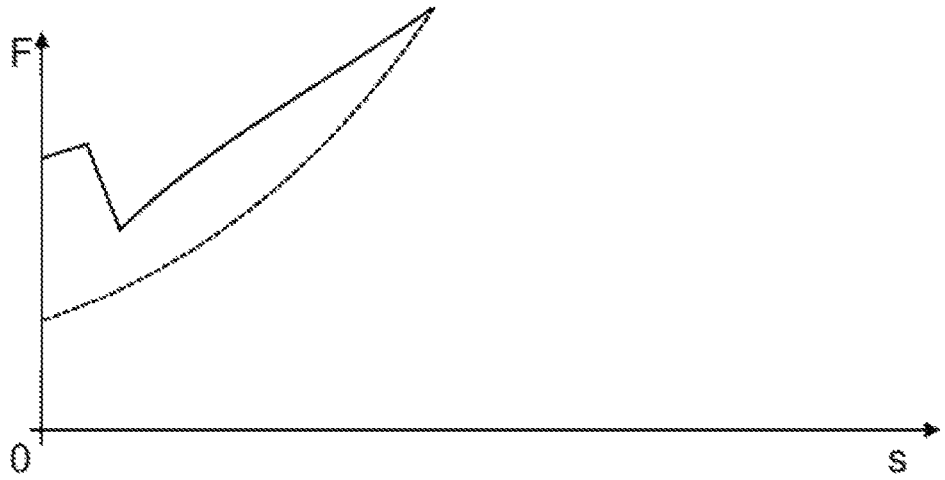

Fig. 8 (Conventional)
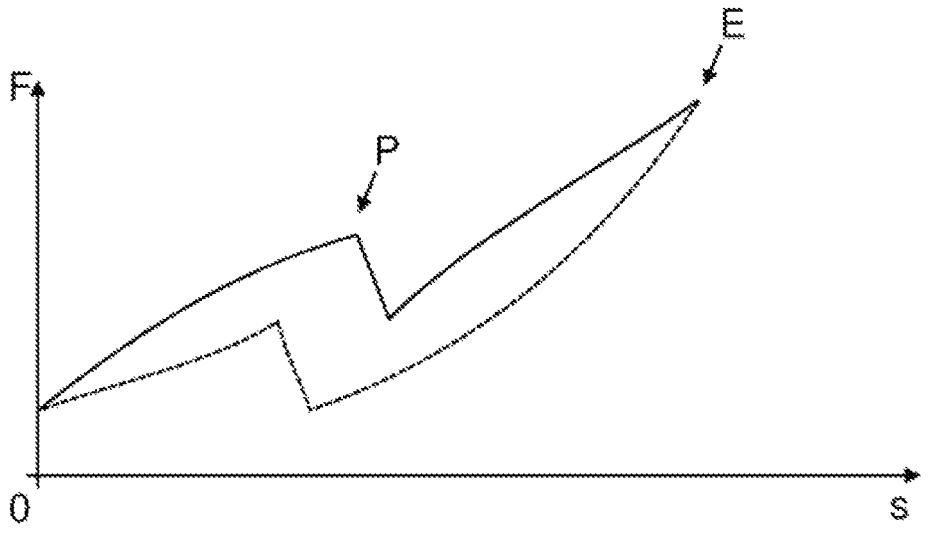

Fig. 12 (Conventional)
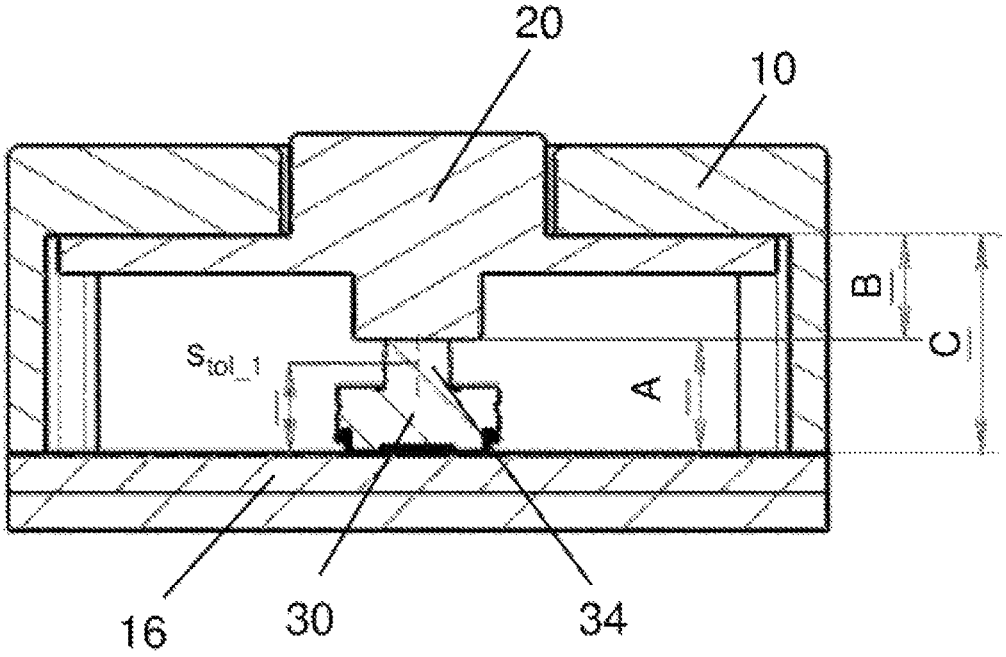

ELECTRIC PUSH-BUTTON SWITCH

CROSS-REFERENCE TO RELATED APPLICATIONS

This application is a continuation of International Application No. PCT/EP2020/072670, published in German, with an international filing date of Aug. 12, 2020, which claims priority to DE 10 2019 005 800.3, filed Aug. 17, 2019, the disclosures of which are incorporated in their entirety by reference herein.

TECHNICAL FIELD

The present invention relates to an electric push-button (or "pushbutton" or "push button") switch including a guide housing, an actuation element, and a mechanical switching element, the switching element having (i) a haptic element that produces a pressure point and (ii) a return spring that generates a restoring force, a casing of the switching element being stationary relative to the guide housing, and the actuation element being movable relative to the guide housing, via which, during a movement of the actuation element relative to the guide housing, the switching element is actuated against the restoring force.

BACKGROUND

An increasing trend in vehicle interiors is the combination of a large number of operating functions in one user interface (i.e., control surface). This is made possible by the use of sensor systems having capacitive or force-sensitive sensors, for example.

There is a continuing desire in many vehicle areas for haptic feedback. A cost-effective approach is the implementation of passive haptics, i.e., a linearly or rotationally supported user interface, which runs through which a defined force-displacement curve due to use of a sensing mat, a microswitch, a snap dome (or snap-action disc), a locking pin, or the like.

In order to impart a contemporary image to the operating elements despite "conventional" technology, it is desirable for the sensors to provide rapid, responsive feedback with increasingly shorter switching paths (i.e., increasingly shorter switching travel). Naturally, this applies over the entire product life cycle, taking all tolerances into account.

To be able to meet these requirements, a method has been proposed in German patent application DE 10 2014 003 087 A1. The proposed method uses an adjustment system to compensate for the variance in the production process after installation.

One disadvantage of this adjustment system is that, in particular for large user interfaces and small installation spaces, it is not always possible to make such an adjustment system accessible from the outside or to integrate such an adjustment system into the installation space.

SUMMARY

An object is to develop a tolerance compensation that requires little installation space, is easily accessible, functions without an additional adjustment process, and enables short-stroke haptics.

In embodiments, an electric pushbutton switch (or electrical tactile switch) includes a guide housing, an actuation element, and a mechanical switching element. The switching element has (i) a haptic element that produces a pressure point and (ii) a return spring that generates a restoring force. A casing of the switching element is stationary relative to the guide housing. The actuation element is movable relative to the guide housing. Movement of the actuation element relative to the guide housing actuates the switching element against the restoring force. The push-button switch further includes at least one resilient element (e.g., at least one coil spring) arranged between the guide housing and the actuation element to compensate for tolerances. The action of spring force of the at least one resilient element being directed in the direction of actuation of the actuation element and against the restoring force of the return spring of the switching element.

Embodiments of the present invention achieve the above object and/or other objects in that at least one resilient tolerance compensation element (e.g., at least one coil spring) is arranged between the guide housing and the actuation element, the elastic force (i.e., spring force) of the coil spring(s) being directed in the actuating direction of the actuation element and opposite the restoring force of the return spring of the switching element.

The tolerance compensation element may be optionally arranged in such a way that the tolerance compensation element is loaded either in compression or in tension.

BRIEF DESCRIPTION OF THE DRAWINGS

An exemplary embodiment of an electric pushbutton switch in accordance with the present invention ("the inventive pushbutton switch") is illustrated and explained in greater detail below with reference to the drawings, which include the following:

FIG. 4 illustrates a conventional pushbutton switch;

FIG. 5 illustrates a sectional view of the conventional pushbutton switch;

FIG. 6 illustrates a first force-displacement curve of the conventional pushbutton switch resulting when the conventional pushbutton switch has excessive play;

FIG. 7 illustrates a second force-displacement curve of the conventional pushbutton switch resulting when the conventional pushbutton switch has excessive pretension;

FIG. 8 illustrates an ideal force-displacement curve of the conventional pushbutton switch resulting when the conventional pushbutton switch has no excessive play and no excessive pretension;

FIG. 12 illustrates a schematic view of the conventional pushbutton switch.

DETAILED DESCRIPTION

Figure 1:
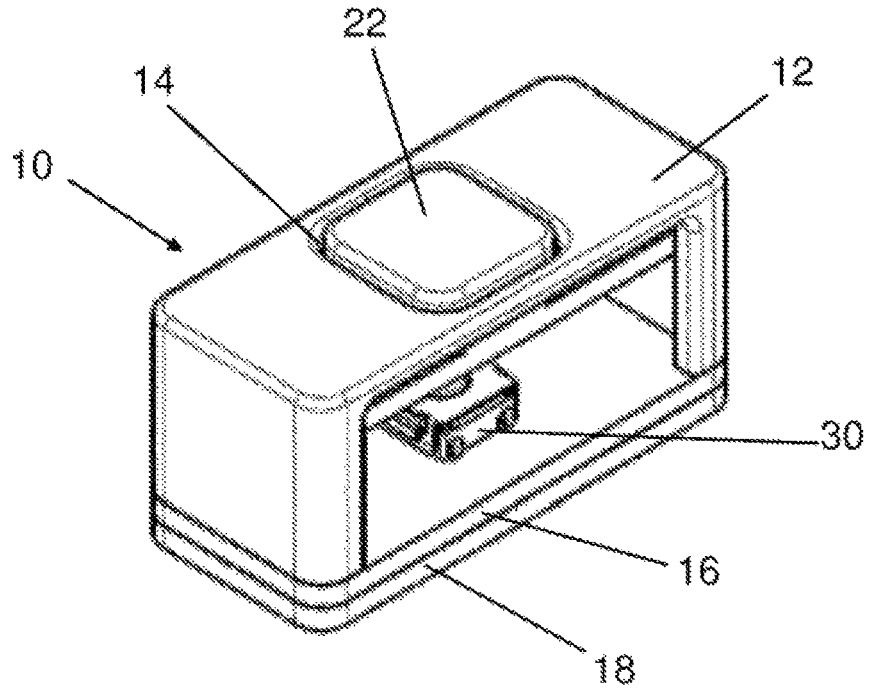
FIG. 1 illustrates a perspective view of the inventive pushbutton switch.

Detailed embodiments of the present invention are disclosed herein; however, it is to be understood that the disclosed embodiments are merely exemplary of the present invention that may be embodied in various and alternative forms. The Figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Referring initially to FIGS. 4 and 5, a conventional electric pushbutton switch is shown. The conventional pushbutton switch includes a guide housing 10, an actuation element (or actuator) 20, and a switching element (or switch) 30. Actuating element 20 and switching element 30 are arranged within guide housing 10.

Actuating element 20 is movable or displaceable relative to guide housing 10. Switching element 30 is stationary relative to guide housing 10. Actuating element 20 is configured to actuate switching element 30. Particularly, actuation element 20 being moved or displaced relative to guide housing 10 towards switching element 30 causes the actuation element to actuate the switching element.

Guide housing 10 is designed as an approximately cuboidal hollow body. Guide housing 10 includes an upper housing part 12. Upper housing part 12 is open on one side.

The conventional pushbutton switch further includes a printed circuit board (PCB) 16 and a base plate 18. Switching element 30 is arranged on PCB 16. PCB 16 is arranged on base plate 18. Base plate 18 closes off the open side of upper housing part 12.

Actuating element 20 includes a button 22. Button 22 protrudes into a panel recess 14 of upper housing part 12. Actuating element 20 further includes, in a lateral projection, two support bars 24 in a one-piece design. As shown in FIG. 5, in the non-actuated state of the conventional pushbutton switch, support bars 24 rest against the bottom side of upper housing part 12. In this position, support bars 24 serve as switching travel end stops.

Switching element 30 may be designed as a microswitch and includes a casing 31, a return spring (or restoring spring) 32, a switch tappet (or switch plunger) 34, and a haptic element 36. Haptic element 36 is, for example, a snap dome or a snap disk.

The underside of actuation element 20 rests against switch tappet 34 of switching element 30. Actuating element 20 is held in its initial position in the non-actuated state of the conventional pushbutton switch by the force of return spring 32 of switching element 30.

When button 22 of actuation element 20 is pressed, return spring 32 is initially compressed via switch tappet 34 and with its elastic force (or spring force) acts on snap dome 36. When a sufficiently large spring force is applied to snap dome 36, snap dome 36 snaps out of its stable initial position into a metastable position in which snap dome 36 closes or opens switching contacts on PCB 16.

When button 22 is released, return spring 32 relaxes. As a result, snap dome 36 snaps back into its initial position and actuation element 20 is returned to its initial position by the restoring force of return spring 32.

However, in this relatively simple design of the conventional pushbutton switch, component tolerances must be considered which make it difficult to produce optimal short-stroke haptics. This applies all the more when an arrangement of multiple pushbutton switches is provided, for which the aim is to have the most uniform switching haptics possible.

If the dimensions of the components of the conventional pushbutton switch, due to manufacturing-related dimensional deviations, are such that spaces form either (i) between upper housing part 12 of guide housing 10 and support bars 24 of actuation element 20 or (ii) between actuation element 20 and switch tappet 34 of switching element 30, then this results in a loose, "shaky" seat of actuation element 20 in guide housing 10. Consequently, this leads to a "loose" or "soft" switching feel (e.g., rattling) during actuation of switching element 30. As such, in this case, the conventional pushbutton switch has excessive play.

On the other hand, if the manufacturing-related dimensions of the components result in return spring 32 of switching element 30 being significantly pretensioned before switching element 30 is actuated, then switch tappet 34 only travels a relatively short actuating path until snap dome 36 snaps. Consequently, due to switching hysteresis, snap dome 36 subsequently remains in the actuated position. As such, in this case, the conventional pushbutton switch is excessively pretensioned.

This is illustrated in FIGS. 6, 7, and 8 which illustrate respective force-displacement curves of the conventional pushbutton switch. In each of FIGS. 6, 7, and 8, for the above-mentioned cases, the actuating force "F" of switching element 30 is plotted with respect to the actuating travel (or actuation path) "S" of actuation element 20 by way of example.

FIG. 8 qualitatively shows an ideal force-displacement curve of the conventional pushbutton switch resulting when the conventional pushbutton switch has no excessive play and no excessive pretension. The upper portion of the ideal force-displacement curve shows the increase in the actuating force F of switching element 20 over the actuating travel S of actuation element 30 due to compression of return spring 32. The drop in the middle portion of the ideal force-displacement curve at the changeover or switching point P ("peak force") shows the snapping of snap dome 36. The end point of the ideal force-displacement curve is reached at the end stop E.

The dashed-line portion of the ideal force-displacement curve shows when actuation element 20 is returning to its initial position after button 22 is released. It is apparent that for the actuating travel S=0, the ideal force-displacement curve begins and ends with an actuating force F>0.

FIG. 6 illustrates a first force-displacement curve of the conventional pushbutton switch resulting when the conventional pushbutton switch has excessive play. The conventional pushbutton switch has excessive play when actuation element 20 has excessive play. The first force-displacement curve shows that the increase in actuating force F of actuation element 20 starts only for an actuating travel S>0 of switching element 30. With no actuating force (i.e., actuating force F=0), the actuating travel S is not clearly defined, resulting in the above-mentioned "loose" or "shaky" design (i.e., rattling).

FIG. 7 illustrates a second force-displacement curve of the conventional pushbutton switch resulting when the conventional pushbutton switch has excessive pretension. The conventional pushbutton switch has excessive pretension when return spring 32 of switching element 30 is significantly pretensioned before switching element 30 is actuated. Accordingly, actuation element 20 is excessively pretensioned by the elastic or spring force of return spring 32. The second force-displacement curve shows that after a short distance of actuating travel S of switching element 30, a one-time response of snap dome 36 occurs. Due to the switching hysteresis, snap dome 36 is no longer able to return to its initial position.

Pushbutton switches having these types of large dimensional deviations may be unusable and are typically sorted out during manufacture. However, this leads to the conclusion that, for reliable functioning of the pushbutton switch, the actuation stroke cannot be smaller than the allowed tolerance travel paths, which may add up in a disadvantageous manner. This makes it difficult to design a cost-effective pushbutton switch having a relatively short actuation stroke.

An electric pushbutton switch in accordance with embodiments of the present invention solves this problem in a simple manner.

Figure 2:
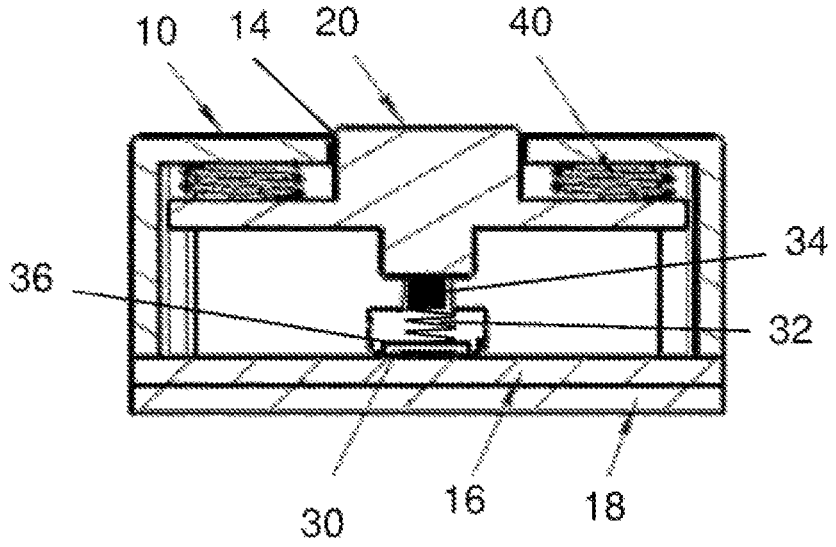
FIG. 2 illustrates a sectional view of the inventive pushbutton switch.
Figure 3:
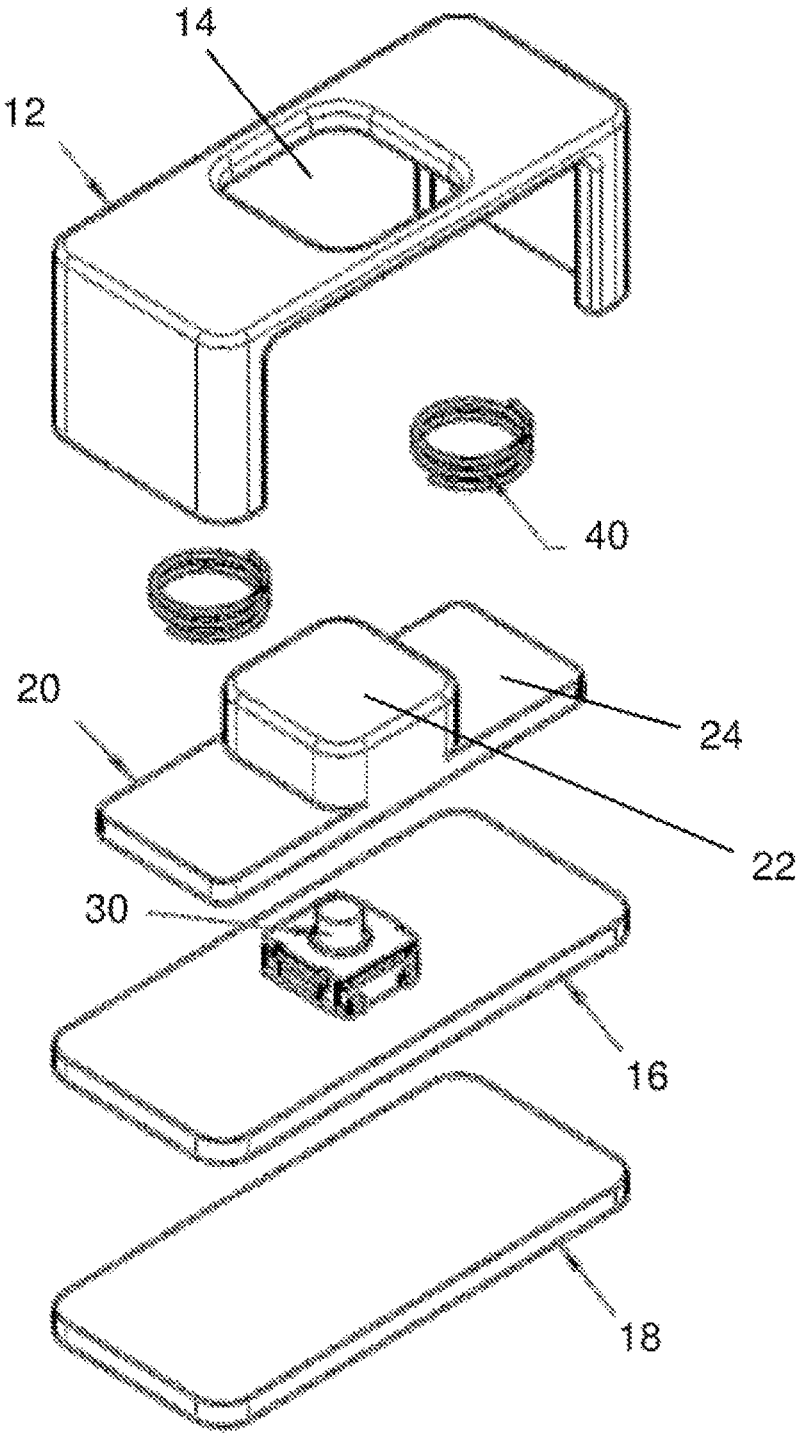
FIG. 3 illustrates an exploded view of the inventive pushbutton switch.

Referring now to FIGS. 1, 2, and 3, with continual reference to FIGS. 4 and 5, an exemplary embodiment of an electric pushbutton switch in accordance with the present invention ("the inventive pushbutton switch") is shown. FIG. 1 illustrates a perspective view of the inventive pushbutton switch; FIG. 2 illustrates a sectional view of the inventive pushbutton switch; and FIG. 3 illustrates an exploded view of the inventive pushbutton switch.

The inventive pushbutton switch solves the noted problem of the conventional pushbutton switch in a simple manner. As the design of the inventive pushbutton switch in many details is the same as the conventional pushbutton switch, a repeated description of the already explained components and their mode of operation may be dispensed with. In addition, for better comparability, identical or functionally equivalent parts of the inventive pushbutton switch have been denoted by the same reference numerals previously used for the conventional pushbutton switch. The primary intent of the following discussion is to describe the differences in design and mode of operation of the inventive pushbutton.

The inventive pushbutton switch, as shown in FIGS. 1, 2, and 3, differs from the conventional pushbutton switch shown in FIGS. 4 and 5, in that the inventive pushbutton switch includes at least one resilient tolerance compensation element 40 arranged between guide housing 10 and actuation element 20. The direction of action of the elastic or spring force of the at least one resilient tolerance compensation element 40 is oriented in the actuating direction of actuation element 20 and opposite to the restoring force of return spring 32 of switching element 30.

In this exemplary embodiment, the inventive pushbutton switch includes two resilient tolerance compensation elements 40 and each resilient tolerance compensation element 40 is a coil spring (or a helical spring).

As shown in FIGS. 2 and 3, coil springs 40 are situated in parallel to one another and are arranged between (i) the inner side of upper housing part 12 of guide housing 10 and (ii) respective support bars 24 of actuation element 20. In each case, coil springs 40 exert an elastic or spring force in the direction toward switching element 30.

When actuation element 20 is not actuated, the spring forces of coil springs 40 are in equilibrium with the elastic or spring force of return spring 32 of switching element 30. As a result, pressing on button 22 of actuation element 20 always begins free of force and the actuating force F of actuation element 20 subsequently increases approximately linearly. In this way, the same haptics are always achieved, at least from a qualitative standpoint.

Coil springs 40 also provide, in the actuating direction, play-free support of actuation element 20 within guide housing 10 and compensate for path or travel tolerances of actuation element 20 within guide housing 10.

The design of the exemplary embodiment of the inventive pushbutton switch shown in FIGS. 1, 2, and 3 is of course only an example to illustrate principles of the concept according to the present invention. Such design may be modified in many ways without departing from the principles of the inventive concept. It is a characteristic of the inventive concept that the at least one resilient tolerance compensation element 40 acts on actuation element 20 before the upper end stop of actuation element 20.

In any case, the force of the at least one resilient tolerance compensation element 40 acts in the actuating direction of button 22 of actuation element 20 and opposite the direction of the restoring force due to return spring 32 of switching element 30. One or multiple resilient tolerance compensation elements 40 may be provided, it being possible to use either tension springs or compression springs.

Figure 9:
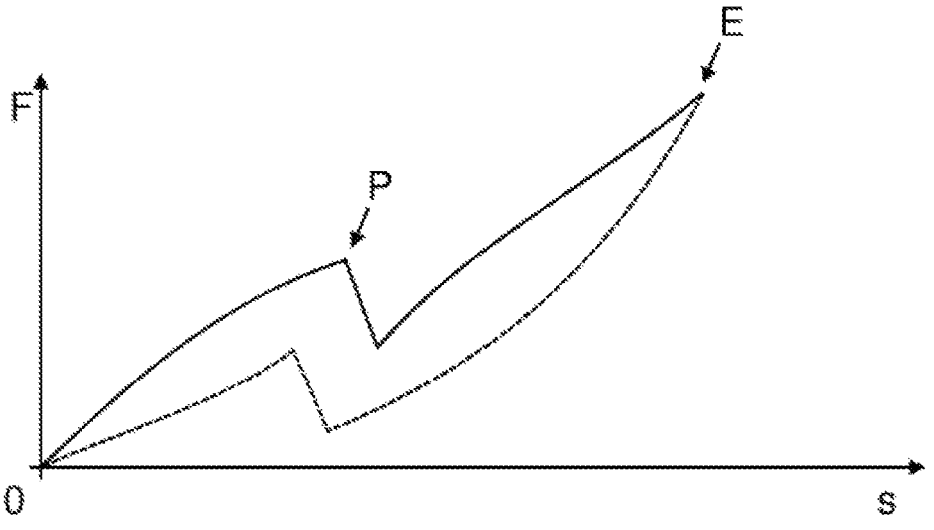
FIG. 9 illustrates a first force-displacement curve of the inventive pushbutton switch resulting when the inventive pushbutton switch has manufacturing-related variations in dimensions of the switch components which would result in the conventional pushbutton switch having excessive play.
Figure 10:
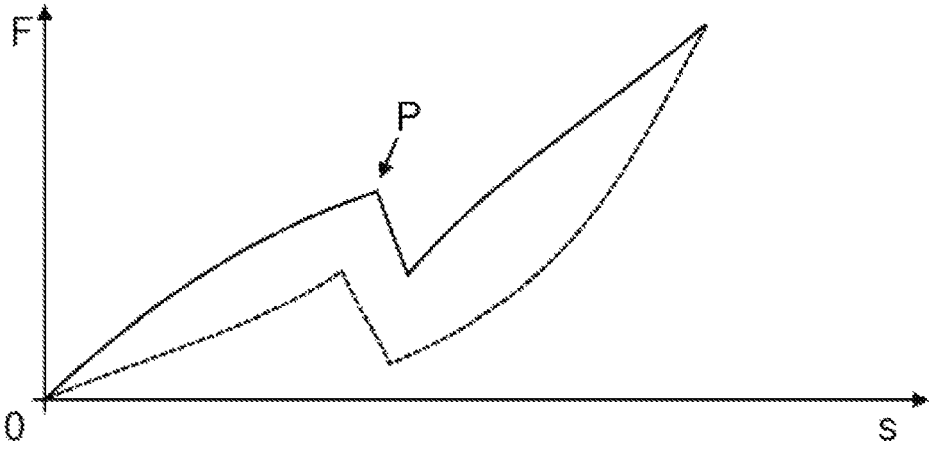
FIG. 10 illustrates a second force-displacement curve of the inventive pushbutton switch resulting when the inventive pushbutton switch has manufacturing-related variations in dimensions of the switch components which would result in the conventional pushbutton switch having excessive pretension.
Figure 11:
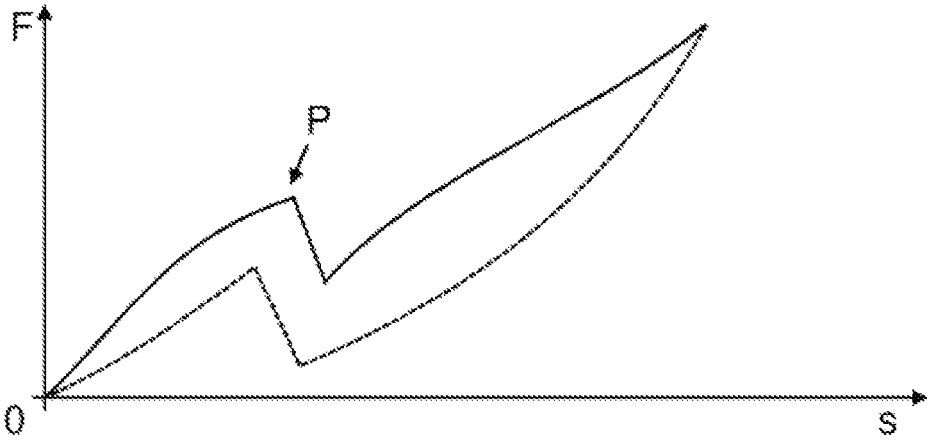
FIG. 11 illustrates a third force-displacement curve of the inventive pushbutton switch resulting when the inventive pushbutton switch has manufacturing-related variations in dimensions of the switch components which would result in the conventional pushbutton switch having no excessive play and no excessive pretension.

Referring now to FIGS. 9, 10, and 11, with continual reference to FIGS. 1, 2, and 3, first, second, and third force-displacement curves of the inventive pushbutton switch are shown. The first force-displacement curve in FIG. 9 results when the inventive pushbutton switch has manufacturing-related variations in dimensions of the switch components which would result in the conventional pushbutton switch having excessive play, such as described with respect to FIG. 6. The second force-displacement curve in FIG. 10 results when the inventive pushbutton switch has manufacturing-related variations in dimensions of the switch components which would result in the conventional pushbutton switch having excessive pretension, such as described with respect to FIG. 7. The third force-displacement curve in FIG. 11 results when the inventive pushbutton switch has manufacturing-related variations in dimensions of the switch components which would result in the conventional pushbutton switch having no excessive play and no excessive pretension, such as described with respect to FIG. 8. Accordingly, the first, second, and third force-displacement curves are different force-displacement curves for pushbutton switches having manufacturing-related variations in dimensions of the switch components, which for a pushbutton switch having a conventional design would result in shaking (FIG. 9), jamming (FIG. 10), or ideal normal functioning (FIG. 11).

Due to the design of the inventive pushbutton switch, the first, second, and third force-displacement curves of FIGS. 9, 10, and 11, respectively, have the same pattern from a qualitative standpoint. It is apparent that each of these force-displacement curves begins free of force when button 22 of actuation element 20 is actuated; i.e., they begin with zero actuating force of switching element 30 (i.e., actuating force F=0 at the beginning of the actuation), and end once again when button 22 is released with zero actuating force of switching element 30 (i.e., actuation force F=0 at the end of the actuation). In these force-displacement curves, only the particular position of the changeover point P of snap dome 36 varies slightly with regard to the actuating travel S of actuation element 20.

The beginning position and end position (actuating travel S=0) of button 22 are determined by the equilibrium position of return spring 32 of switching element 30 and of the tolerance compensation elements 40. These positions may differ slightly due to spring tolerances for various pushbutton switches, but without adversely affecting the functioning.

The reason for the different behavior of the conventional pushbutton switch compared to the inventive pushbutton switch is explained in greater detail with reference to FIGS. 12 and 13. FIG. 12 illustrates a schematic view of the conventional pushbutton switch and FIG. 13 illustrates a schematic illustration of the inventive pushbutton switch.

The position of the changeover point P of the conventional pushbutton switch illustrated in FIG. 12 depends on various dimensions of the switch components that are more or less well maintained for manufacturing reasons.

These dimensions are (i) the height A of switching tappet 34 of switching element 30 above PCB 16, (ii) the size B of actuation element 20 in the switching direction, and (iii) the height C of guide housing 10 above PCB 16. The dimensions A, B, and C of the conventional pushbutton switch together determine the switching travel tolerance $S_{tol_1}$ of the conventional pushbutton switch. The position of actuation element 20 relative to switching element 30 is thus significantly influenced by the dimensional deviations of various switch components.

Figure 13:
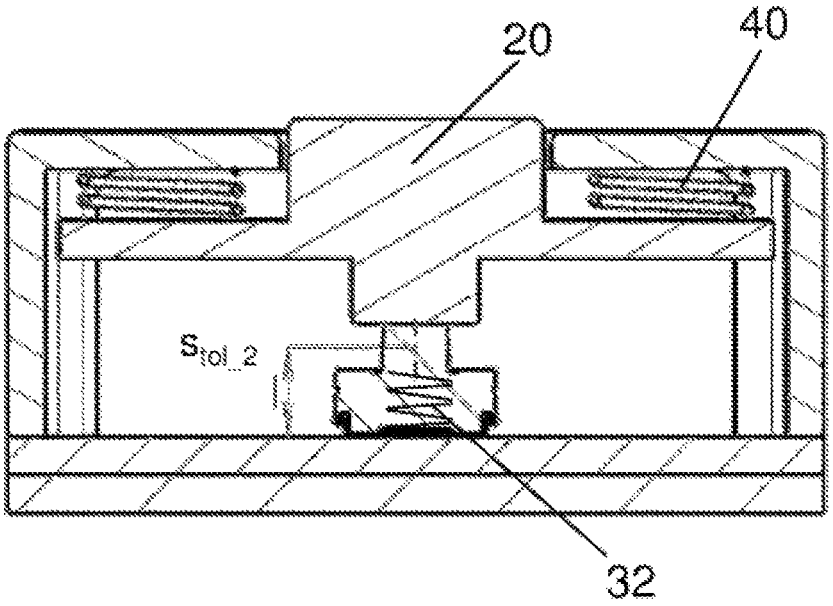
FIG. 13 illustrates a schematic view of the inventive pushbutton switch.

In contrast, for the inventive pushbutton switch illustrated in FIG. 13, the starting position of actuation element 20 is determined essentially by the equilibrium position of two spring systems. Namely, return spring 32 of switching element 30 on the one hand, and tolerance compensation elements 40 (coil springs 40) on the other hand. Tolerance compensation elements 40 to a significant extent compensate for the dimensional deviations, likewise present here, of the switch components. A switching travel tolerance $S_{tol_2}$ of the inventive pushbutton switch may thus be achieved which is significantly smaller, and often only a fraction of the switching travel tolerance $S_{tol_1}$ of the conventional pushbutton switch.

Thus, due to the arrangement of the inventive pushbutton switch, the influence of the tolerances of the individual components on the switching path is reduced.

The inventive pushbutton switch is advantageous in that no calibration is required, and as a result it is not necessary to provide external access for adjustment systems. The inventive pushbutton switch is also advantageous that due to the tolerance compensation elements, soft end stops are provided which reduce the noise when the end stops are reached.

A further advantage of the inventive pushbutton switch its design compensates for influences of temperature and moisture.

| Reference numerals and symbols | |
|---|---|
| 10 | guide housing |
| 12 | upper housing part |
| 14 | panel recess |
| 16 | printed circuit board |
| 18 | base plate |
| 20 | actuation element (actuator) |
| 22 | button |
| 24 | support bars |

-continued

| Reference numerals and symbols | |
|---|---|
| 30 | switching element (switch) (e.g., microswitch) |
| 32 | return spring (restoring spring) |
| 34 | switch tappet (switch plunger) |
| 36 | haptic element (e.g., snap dome or snap disk) |
| 40 | resilient tolerance compensation element(s) (e.g., coil spring(s)) |
| A, B, C | dimensions of switch components |
| E | end stop |
| F | actuating force |
| P | changeover or switching point (peak force) |
| S | actuating travel (actuation path) |
| $S_{tol_1}$, $S_{tol_2}$ | switching travel tolerances |

While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. An electric pushbutton switch comprising:

a guide housing;

a switching element having a casing, a haptic element that produces a pressure point, and a return spring that generates a restoring force, the casing being stationary relative to the guide housing;

an actuator for actuating the switching element, the actuator being movable relative to the guide housing, wherein the actuator actuates the switching element against the restoring force when the actuator is moved relative to the guide housing in an actuating direction of the actuator towards the switching element; and at least one resilient tolerance compensation element arranged between the guide housing and the actuator, each resilient compensation element having a spring force directed in the actuating direction of the actuator towards the switching element and opposite the restoring force of the return spring of the switching element.

2. The electric pushbutton switch of claim 1 wherein:

the switching element is a microswitch.

3. The electric pushbutton switch of claim 1 wherein:

the actuator includes a button.

4. The electric pushbutton switch of claim 1 further comprising:

a printed circuit board; and wherein the switching element is arranged on the printed circuit board.

5. The electric pushbutton switch of claim 1 wherein:

the actuator includes a support bar and a button supported thereon; and each resilient tolerance compensation element is arranged between the guide housing and respective portion of the support bar to be arranged between the guide housing and the actuator.

6. The electric pushbutton switch of claim 1 wherein:

the actuator includes a button and first and second support bars in a one-piece design;

the at least one resilient tolerance compensation element includes first and second resilient tolerance compensation elements; and the first resilient tolerance compensation element is arranged between the guide housing and the first support bar to be arranged between the guide housing and the actuator and the second resilient tolerance compensation element is arranged between the guide housing and the second support bar to be arranged between the guide housing and the actuator.

7. The electric pushbutton switch of claim 1 wherein:

the switching element further includes a switch tappet; and wherein an underside of the actuator rests against the switch tappet.

8. The electric pushbutton switch of claim 1 wherein:

the at least one resilient tolerance compensation element includes at least one coil spring.

9. The electric pushbutton switch of claim 1 wherein:

the at least one resilient tolerance compensation element includes two resilient tolerance compensation elements, and each resilient tolerance compensation element is a coil spring.

10. The electric pushbutton switch of claim 9 wherein:

the two coil springs are situated in parallel to one another.

11. The electric pushbutton switch of claim 1 wherein:

in an unactuated state of the actuator, the spring force of each resilient tolerance compensation element is in equilibrium with the restoring force of the return spring of the switching element whereby actuation of the actuator begins and ends with being free of force.

12. The electric pushbutton switch of claim 1 wherein:

the haptic element is a snap dome.

* * * * *